US006021174A

United States Patent [19]

Campbell

[11] Patent Number: 6,021,174

[45] Date of Patent: Feb. 1, 2000

[54] USE OF SHAPED CHARGE EXPLOSIVES IN THE MANUFACTURE OF X-RAY TUBE TARGETS

[75] Inventor: Robert B. Campbell, Naperville, Ill.

[73] Assignee: Picker International, Inc., Highland Heights, Ohio

[21] Appl. No.: 09/179,003

[22] Filed: Oct. 26, 1998

[51] Int. Cl.[7] ..... H01J 35/10

[52] U.S. Cl. ..... 378/125; 378/144; 419/28; 445/28

[58] Field of Search ..... 445/28; 419/28; 378/125, 144

[56] References Cited

U.S. PATENT DOCUMENTS

| | | | |
|---|---|---|---|
| 2,111,412 | 3/1938 | Ungelenk . | |
| 3,639,179 | 2/1972 | Reichman | 419/28 |
| 4,641,333 | 2/1987 | Goossens et al. | 445/28 |
| 4,788,705 | 11/1988 | Anderson . | |
| 5,384,820 | 1/1995 | Burke . | |

OTHER PUBLICATIONS

Mason & Hanger, a corporation of Amarillo, Tx "Explosive Materials Processing" May 1998.

*Primary Examiner*—Kenneth J. Ramsey
*Attorney, Agent, or Firm*—Fay, Sharpe, Fagan, Minnich & McKee, LLP

[57] ABSTRACT

An explosive forming process provides an anode (10) suitable for use in a high energy x-ray tube. The process includes applying a shaped charge (54, 80, 90, 92) to a refractory material which has been formed in the general shape of the anode. The configuration of the charge is calculated to provide a target area (16) on the anode of uniform, high density which does not tend to outgas in the high vacuum conditions of the x-ray tube. The explosive process is capable of forming anodes with much larger diameters than is possible with conventional forging techniques.

20 Claims, 2 Drawing Sheets

USE OF SHAPED CHARGE EXPLOSIVES IN THE MANUFACTURE OF X-RAY TUBE TARGETS

BACKGROUND OF THE INVENTION

The present invention relates to the radiographic arts. It finds particular application in the conjunction with forming of rotating anodes found in x-ray tubes for use with CT scanners and will be described with particular reference thereto. It should be appreciated, however, that the invention may also find application in other x-ray medical and non-medical devices, and the like.

A high power x-ray tube typically includes a thermionic filament cathode and a rotating anode which are encased in an evacuated envelope. A heating current, commonly of the order of 2–5 amps is applied through the filament to create a surrounding electron cloud. A high potential, of the order of 100–200 kilovolts, is applied between the filament cathode and the anode to accelerate the electrons from the cloud towards an anode target area. The electron beam impinges on a small area of the anode, or target area, with sufficient energy to generate x-rays. The acceleration of electrons causes a tube or anode current of the order of 5–200 milliamps. Only a small fraction of the energy of the electron beam is converted into x-rays, the majority of the energy being converted to heat.

To inhibit the target area from overheating, the anode rotates at high speeds during x-ray generation. The electron beam does not dwell on the small impingement spot of the anode long enough to cause thermal deformation. The diameter of the anode is sufficiently large that in one rotation of the anode, each spot on the anode that was heated by the electron beam has substantially cooled before returning to be reheated by the electron beam. Larger diameter tubes have larger circumferences, hence provide greater thermal loading.

The anodes are formed from a refractory material, such as an alloy of titanium, zinc and molybdenum, with an outer ring in the target area of tungsten or a tungsten rhodium alloy. The materials for the anode are compressed, in powder form, into an annular mold and sintered in a hydrogen atmosphere to form a solidified body about 1 cm thick and about 10 cm in diameter. The body contains numerous pores. These must be removed before the anode is used in the x-ray tube to prevent the introduction of gases into the envelope. The vacuum conditions are such as to cause slow outgassing from the pores, which is detrimental to the operation of the tube. Additionally, defects in the surface of the anode can lead to eccentricities in the rotation of the anode and poor quality of the x-ray beam.

Accordingly, the sintered body is conventionally heated to a temperature of around 800° C. and pressed in a forge. The force required to compress the body to the density required for x-ray anodes is considerable. For a standard 10 cm anode, a force of about 200,000 tons is used. The force required increases with the square of the anode radius.

Recently, demands have been made for larger and larger x-ray anodes. Anodes of 20 cm or larger would be beneficial for certain applications. Currently, the maximum size of the anode is limited by the capabilities of the forge and the pressures which it is able to apply. There remains a need for a method of forming anodes of these larger dimensions.

In a number of industries, chemical high explosives have been used for shaping, welding, and cladding metals. High explosive forming has been carried out in one of two methods. In the standoff method, an explosive charge is located at some predetermined distance from the blank or shape to be formed. Water is generally used as a transfer medium for uniform transmission of energy from the explosion to the workpiece and to muffle the sound of the blast. In the "contact forming" method, the explosive charge is held in intimate contact with the workpiece.

Interface pressures acting on the workpiece can be a million or more kilograms per square centimeter, resulting in rapid shaping of the metal. However, stress waves tend to be induced in the metal which result in displacement, deformation, and possible fracture. Such uncontrolled explosive techniques do not guarantee a highly uniform target area suitable for x-ray anodes.

Techniques developed in the thermonuclear industry in the area of complex shaped explosive charges for initiating the fission of plutonium spheres have the ability to provide a controlled explosion. The present invention adapts these techniques to the compression of x-ray anodes.

The present invention provides a new and improved method of forming x-ray anodes which overcomes the above referenced problems and others.

SUMMARY OF THE INVENTION

According to one aspect of the invention, a method for forming an x-ray anode is provided. The method includes forming an anode form in a general shape of the x-ray anode by sintering a powdered anode material and increasing the density of the anode form by explosively compressing the anode form with a shaped explosive charge. The shape of the charge is selected to compress the anode form uniformly at least in a target area of the anode form.

In accordance with another aspect of the present invention an anode for an x-ray tube is provided. The tube includes a disk of a dense anode material which has been formed by explosively compressing an anode form with a shaped explosive charge. The shape of the charge is selected to compress the anode form uniformly at least in a target area of the anode form.

In accordance with yet another aspect of the present invention, an x-ray tube is provided. The tube includes an evacuated envelope and an anode and a cathode within the envelope. The anode includes a disk of a dense anode material which has been formed by explosively compressing an anode form with a shaped explosive charge.

One advantage of the present invention is that it enables x-ray anodes of much larger diameter to be formed than is conventionally possible.

Another advantage of the present invention is that anodes are formed without large-scale presses, providing considerable cost savings in the forming of the anodes.

A yet further advantage is that anodes are formed with uniform, high densities and with few surface imperfections, resulting in extended life of x-ray tubes formed from the anodes.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

An explosive forming process allows x-ray anodes of high density and large diameter to be formed for use in high energy x-ray tubes, and the like.

Figure 1:
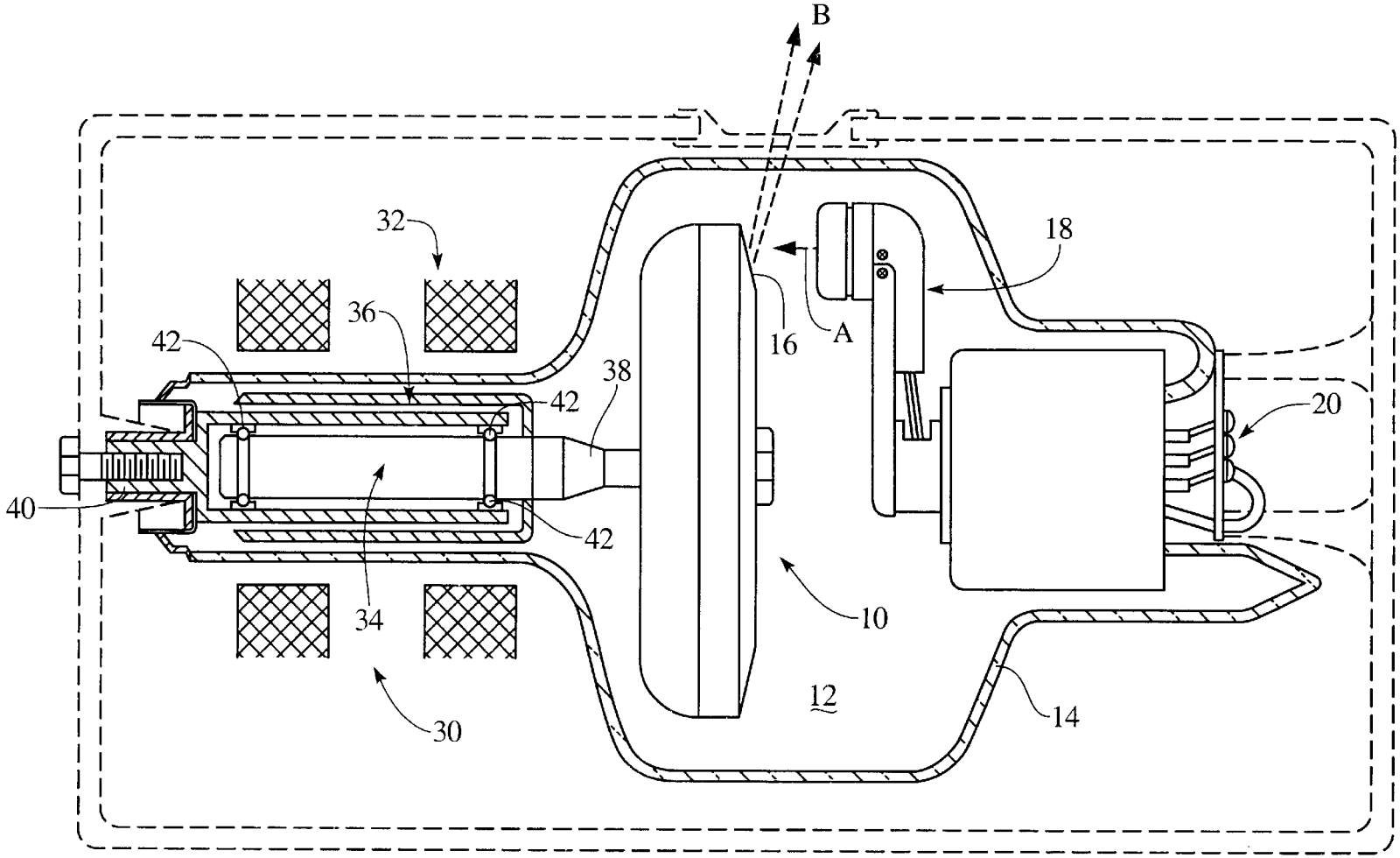
FIG. 1 is a schematic side view of an x-ray tube according to the present invention.

With reference to FIG. 1, a rotating anode tube of the type used in medical diagnostic systems for providing a focused beam of x-ray radiation is shown. The tube includes a rotating anode 10 which is operated in an evacuated chamber 12 defined by a glass envelope 14. The anode is disc-shaped and beveled adjacent its annular peripheral edge to define an anode surface or target area 16. A cathode assembly 18 supplies and focuses an electron beam A which strikes the anode surface 16. Filament leads 20 lead in through the glass envelope to the cathode assembly to supply an electrical current to the assembly. When the electron beam strikes the rotating anode, a portion of the beam is converted to x-rays B which are emitted from the anode surface and a beam of the x-rays passes out of the tube through the envelope 14.

An induction motor 30 rotates the anode 10. The induction motor includes a stator having driving coils 32, which are positioned outside the glass envelope, and a rotor 34, within the envelope, which is connected to the anode 10. The rotor includes an armature or sleeve 36 which is connected to the anode by a neck 38 of molybdenum or other suitable material. The armature 36 is formed from a thermally and electrically conductive material, such as copper. When the motor is energized, the driving coils induce magnetic fields in the armature which cause the armature to rotate relative to a rotor support 40 of the rotor. Bearings 42, positioned between the armature and the rotor support, allow the armature to rotate smoothly about the rotor support 40.

The anode is prepared by compressing powdered anode materials into a mold. Preferably, the materials include a mixture of titanium, zinc, and molybdenum, with an annular peripheral band of tungsten in the x-ray target area, although other conventional anode materials may alternatively be employed. A binder is optionally added to hold the powdered materials together.

The compressed powdered anode materials are then sintered to a temperature of about 800° C. to form an anode form with the approximate dimensions of the anode. The sintering step provides the anode with sufficient strength for handling in a final, explosive compression step. Although sintering is the preferred method of providing this strength, other forming methods are also contemplated.

Figure 2:
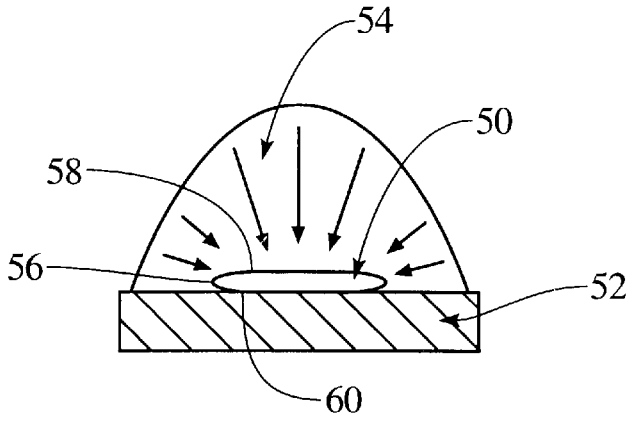
FIG. 2 shows a shaped explosive charge arrangement according to a first embodiment of the present invention.
Figure 3:
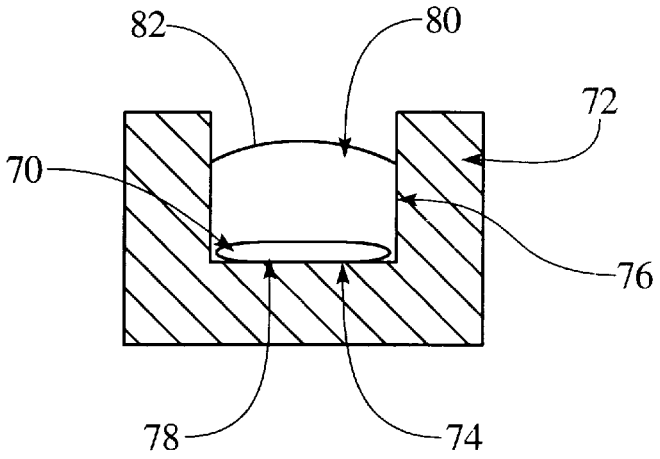
FIG. 3 shows a shaped explosive charge arrangement according to a second embodiment of the present invention; and, FIG. 4 shows a shaped explosive charge arrangement according to a third embodiment of the present invention.
Figure 4:
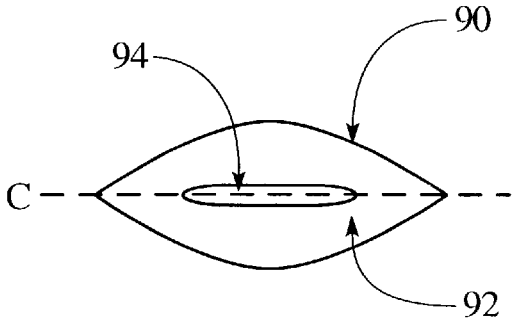

The sintered anode form is then explosively compressed using a shaped explosive charge. The shape of the charge is calculated to compress the form to a uniform density in the final shape of the anode. Symmetrical charges are preferred for this purpose. The shaped charge is detonated by a suitable detonator, depending on the type of explosive material used for the charge. Compressive forces developed by the charge act on outer surfaces of the anode form, which are transferred to the interior of the anode form as the anode form is compressed. The shaped charge acts like a lens, focussing the compressive forces in a manner that controls the pressures delivered over the area of the anode form. FIGS. 2–4 show three embodiments of shaped charge configurations for providing a high density, compressed anode.

With reference to FIG. 2, in one embodiment, a sintered anode form 50 is positioned on a flat die 52. An explosive charge 54 is shaped so that the explosive force is applied to a perimeter 56 and to an upper surface 58 of the anode form. A lower surface 60 is compressed by the die when the explosive charge explodes, pressing the anode form against the die.

With reference to FIG. 3, in another embodiment, an anode form 70 is positioned in a cylindrical die 72, having a base 74 and a cylindrical side 76. A lower surface 78 of the anode form is in contact with the base. An explosive charge 80 is packed into the die so that an upper surface 82 of the charge is elliptically shaped. When the charge explodes, the geometries of the die, explosive charge, and anode form are such that compression forces are exerted on the anode form, compressing it to a uniform density. The base 74 and the sides 76 are, optionally, precisely machined in accordance with the intended parameter and contour of the upper surface and tungsten target area of the finished anode.

With reference to FIG. 4, symmetrical upper and lower explosive charges 90 and 92, respectively, are positioned around an anode form 94. The anode form may be supported about a central axis C during explosive compression.

Obviously, a variety of other die and charge shapes may be used, depending on the overall shape and density of the anode desired. In one embodiment, the shape of the charge is determined such that density of the anode is higher in the target area than in the rest of the anode. However, the density still remains uniform throughout an annular ring defined by the target area 16.

Optionally, the anode form is preheated to a temperature of around 1000° C. prior to detonating the charge. However, because of the high temperatures generated by the explosive charge the preheating step may be eliminated.

The die is formed from a material which does not spall or deform unduly during the explosive compression. Because the anodes demand close tolerance control, it is preferable to use a fresh die for each anode.

Preferably, the anode 10 includes a central bore for connecting the anode to the neck 38 of the rotor. The bore may be formed prior to sintering, by using an annular mold for shaping the powdered materials. Alternatively, the bore is formed after explosive compression of the anode form. Suitable boring techniques are used to drill the bore. The final shape of the anode may be achieved by conventional shaping techniques, such as grinding, milling, and the like.

A variety of explosive materials are contemplated for forming the explosive charge. These include trinitrotoluene (TNT), cyclotrimethylene trinitramine (RDX), pentaethrytol tetranitrate (PETN), Pentolite, Tetryl, C-3, blasting gelatin, dynamite, and other knowr high explosives. Particularly preferred explosives are plastic-bonded explosives that have been formulated with an organic polymer that functions as a binder to produce a moldable powder. Such explosives are available from Mason & Hanger, Amarillo, Tex., and include mixtures of TATB and HMX with various binders, and mixtures of TATB and PETN with Kel-F binder and HiKel 800.

Such explosive charges deliver in excess of ten times the compressive force of conventional forging presses. Anodes having diameters of 20–30 cm, and above, are thus readily formed by this explosive forming process.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An anode for an x-ray tube comprising:

a disk of a dense anode material which has been formed by explosively compressing an anode form with a shaped explosive charge, the shape of the charge being selected to compress the anode form uniformly at least in a target area of the anode form.

2. The anode of claim 1, wherein the anode has a diameter of 20 cm, or above.

3. The anode of claim 2, wherein the anode has a diameter of 30 cm, or above.

4. The anode of claim 1, wherein the disk defines a central bore for receiving a shaft of a rotor.

5. The anode of claim 1, wherein the anode material includes tungsten, the tungsten being disposed at least in an x-ray target area adjacent perimeter of the anode.

6. The anode of claim 5, wherein the anode material also includes an element selected from the group consisting of molybdenum, titanium, zinc and combinations thereof.

7. An x-ray tube comprising:

an evacuated envelope;

an anode within the envelope, the anode including a disk of a dense anode material which has been formed by explosively compressing an anode form with a shaped explosive charge, the shape of the charge being selected to compress the anode form uniformly in a target area of the anode form; and, a cathode supported within the envelope.

8. The x-ray tube of claim 7, wherein the anode has a diameter of 20 cm, or above.

9. The x-ray tube of claim 8, wherein the anode has a diameter of 30 cm, or above.

10. A method for forming an x-ray anode, the method comprising:

forming an anode form in a general shape of the x-ray anode by sintering a powdered anode material;

increasing the density of the anode form by explosively compressing the anode form with a shaped explosive charge, the shape of the charge being selected to compress the anode form uniformly at least in a target area of the anode form.

11. The method of claim 10, wherein the powdered anode material includes tungsten.

12. The method of claim 11, wherein the anode material further includes a material selected from the group consisting of molybdenum, titanium, zinc, and combinations thereof, and wherein the method further includes before the sintering step:

compressing the powdered anode material into a mold such that the tungsten is disposed around the periphery of compressed anode material in an x-ray target ring.

13. The method of claim 12, wherein the step of compressing the powdered material includes forming a bore within the powdered material by compressing the powdered material into an annular mold.

14. The method of claim 10 wherein the step of increasing the density of the anode form by explosively compressing the anode form includes:

packing the explosive charge symmetrically around the anode form about an axis passing through a longest dimension of the anode form.

15. The method of claim 14, wherein the anode form is supported about the axis during detonation of the explosive charge.

16. The method of claim 10 wherein the step of increasing the density of the anode form by explosively compressing the anode form includes:

supporting a lower surface of the anode with a die, and packing the explosive charge adjacent a perimeter and an upper surface of the anode form.

17. The method of claim 16, wherein the die defines a container with a base and a cylindrical wall and wherein the anode form is supported by the base of the container.

18. The method of claim 10, further including, before the step of increasing the density of the anode:

heating the anode form to a temperature of about 1000° C.

19. The method of claim 10, further including, after the step of increasing the density of the anode:

forming a bore through the anode for receiving a rotor shaft.

20. An x-ray tube with an anode formed by the method of claim 10.

* * * * *